US008807351B2

(12) United States Patent
Lin et al.

(10) Patent No.: US 8,807,351 B2
(45) Date of Patent: Aug. 19, 2014

(54) MOUNTING APPARATUS FOR SLIDE RAIL

(75) Inventors: Shu-Chen Lin, Tu-Cheng (TW); Chen-Sheng Tang, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 448 days.

(21) Appl. No.: 13/151,286

(22) Filed: Jun. 2, 2011

(65) Prior Publication Data

US 2012/0292274 A1 Nov. 22, 2012

(30) Foreign Application Priority Data

May 18, 2011 (TW) ..... 100117481 A

(51) Int. Cl.
*A47F 7/00* (2006.01)
*A47B 88/00* (2006.01)

(52) U.S. Cl.
USPC ..... 211/26; 312/334.4

(58) Field of Classification Search
USPC ..... 211/26, 192; 312/223.1, 265.1–265.4, 312/319.1, 334.1, 334.4, 334.5; 248/201, 248/298.1, 220.21, 220.31, 220.41
See application file for complete search history.

(56) References Cited

U.S. PATENT DOCUMENTS 6,749,275 B2 * 6/2004 Cutler et al. ..... 312/334.4
6,929,339 B1 * 8/2005 Greenwald et al. ..... 312/334.4
6,935,711 B1 * 8/2005 Naue et al. ..... 312/334.4
6,957,878 B2 * 10/2005 Greenwald et al. ..... 312/334.4
7,357,362 B2 * 4/2008 Yang et al. ..... 248/221.11
7,731,142 B2 * 6/2010 Chen et al. ..... 248/244
7,798,581 B2 * 9/2010 Chen et al. ..... 312/265.1
7,857,145 B2 * 12/2010 Mushan et al. ..... 211/26
8,104,626 B2 * 1/2012 Huang et al. ..... 211/26
2005/0189855 A1 * 9/2005 Naue et al. ..... 312/334.4
2009/0309471 A1 * 12/2009 Yu et al. ..... 312/334.44
2009/0315434 A1 * 12/2009 Yu et al. ..... 312/223.2
2010/0200523 A1 * 8/2010 Henderson ..... 211/26
2010/0243586 A1 * 9/2010 Henderson et al. ..... 211/26.2
2012/0145850 A1 * 6/2012 Yu et al. ..... 248/220.22

* cited by examiner

*Primary Examiner* — Joshua Rodden
*Assistant Examiner* — Patrick Hawn
(74) *Attorney, Agent, or Firm* — Novak Druce Connolly Bove + Quigg LLP

(57) ABSTRACT

A demountable mounting apparatus for fixing a slide rail to a post includes a mounting bracket secured to the slide rail, a coupling member fixed to the mounting bracket, a latch member rotatably mounted to the mounting bracket, and a restoring member between the latch member and the mounting bracket. The coupling member includes an inserting pin extending into the through hole of the post, and defining a receiving slot. The latch member includes an arm to be received in the receiving slot of the inserting pin, and a hook protruding from the arms. The latch member is locked in a position by the hooks engaging the far surface of the post. A rotation of latch member makes the hooks disengage from the post, thereby allowing the release of the slide rail from the post. The restoring member biases the latch member to the locked position.

6 Claims, 5 Drawing Sheets

MOUNTING APPARATUS FOR SLIDE RAIL

BACKGROUND

1 . Technical Field

The present disclosure relates to mounting apparatuses and, more particularly, to an apparatus for mounting a slide rail.

2 . Description of the Related Art

Traditionally, a slide rail provides movement between two objects such as a desk and a drawer or a server and a rack, etc.

A conventional slide rail assembly, for instance, one for a desk drawer, includes an outer slide rail mounted to the desk, an inner slide rail mounted to the drawer, and an intermediate slide rail mounted between the outer and inner slide rails. The intermediate slide rail can move inside the outer slide rail, and also move along the inner slide rail, thus the drawer can be pulled out from the desk. Screws are used for mounting the outer slide rail to the desk, and the positioning and fixing of the outer slide rail is inconvenient and time-consuming.

DETAILED DESCRIPTION

Figure 1:
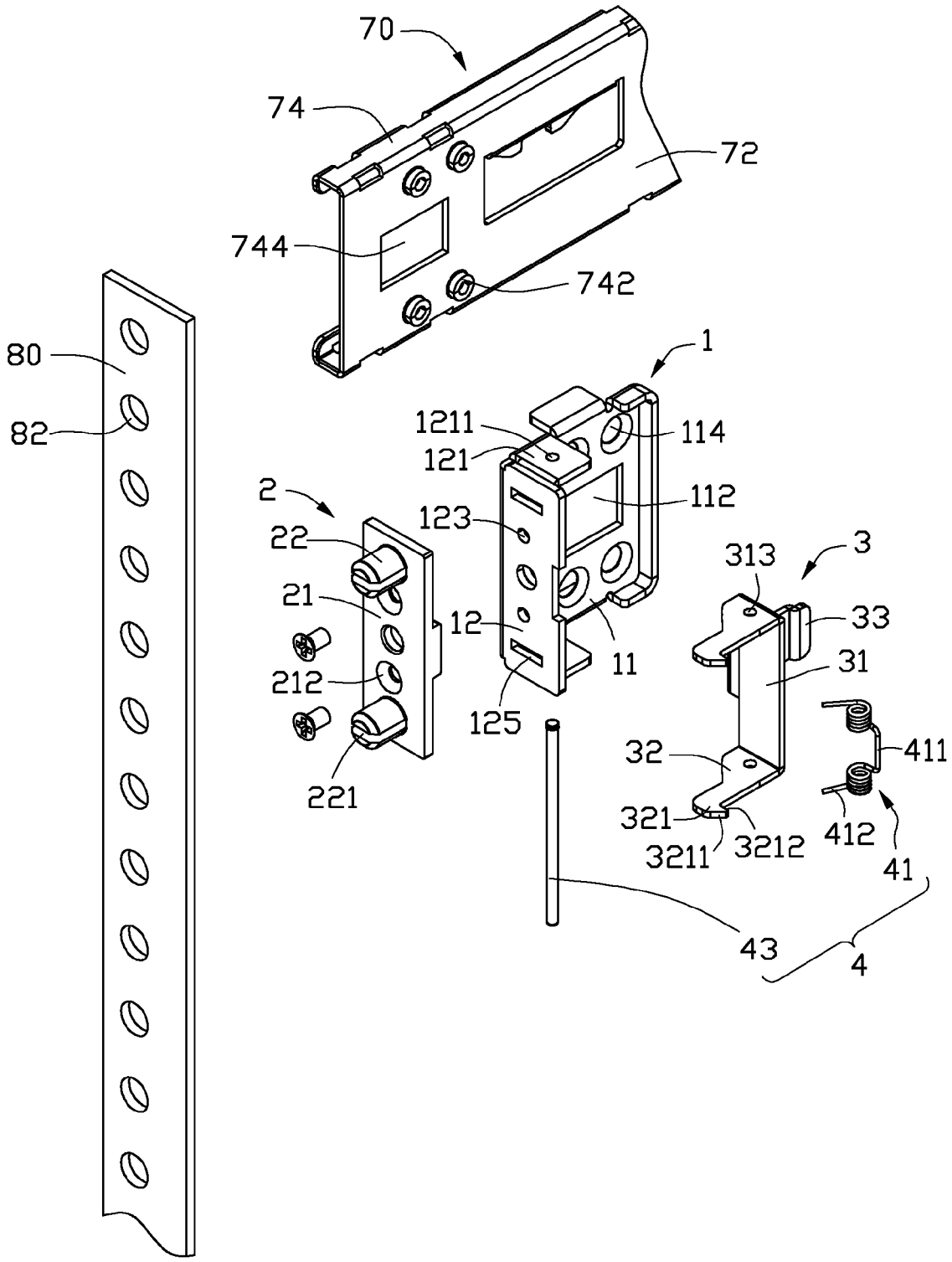
FIG. 1 is an exploded, isometric view of an embodiment of a mounting apparatus, a slide rail, and a rack post, the mounting apparatus includes a mounting bracket, a coupling member, a latch member, and a restoring member.
Figure 2:
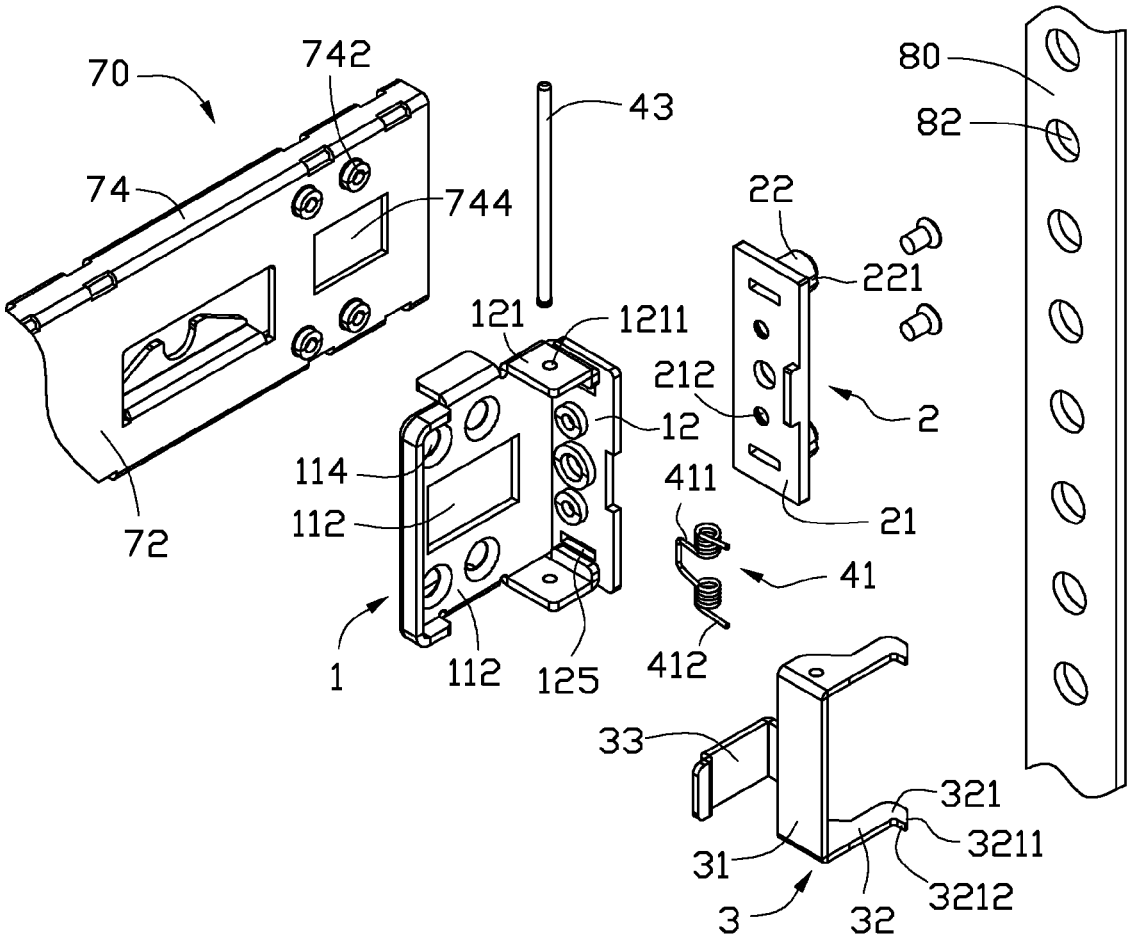
FIG. 2 is similar to FIG. 1, but shows a different perspective.

FIGS. 1 and 2 show an embodiment of a mounting apparatus used for mounting a slide rail 70 to a component rack. The component rack may include a rack post 80 defining a plurality of round through holes 82. The mounting apparatus includes a mounting bracket 1, a coupling member 2, a latch member 3, and a restoring member 4.

The slide rail 70 is substantially a geometric "C" in cross section, and includes a web 72 with two flanges 74 extending from the top and bottom of the web 72. A plurality of bosses 742 protrudes from an outer surface of the web 72. An opening 744 is defined in the web 72 between the topmost and bottommost of the bosses 742.

The mounting bracket 1 includes a fixing plate 11, and an end plate 12 at one side of the fixing plate 11 and at a right angle to it. A plurality of fixing holes 114 is defined in the fixing plate 11, and an interfere-avoiding hole 112 is arranged among the fixing holes 114. Two pivot tabs 121, each defining a retaining hole 1211, are singularly mounted behind the upper and lower ends respectively of the end plate 12. The end plate 12 also defines two securing holes 123, and two slide slots 125 outside the securing holes 123.

The coupling member 2 includes a base plate 21, and two inserting pins 22 extending out perpendicularly from the base plate 21. The base plate 21 defines two positioning holes 212 arranged between the inserting pins 22. Two receiving slots 221 are defined diametrically in the coupling member 2, slots 221 extend through the inserting pins 22 and through the base plate 21. Each of the inserting pins 22 is round in cross section.

The coupling member 3 includes a middle portion 31, two arms 32 respectively extending forwards from opposite ends of the middle portion 31, and a manipulation portion 33 extending rearwards from the middle portion 31. A hook 321 is defined at the distal ends of each of the arms 32. Each hook 321 forms a guiding slope 3211 facing forwards, and a stop side 3212 facing rearwards. Each of the arms 32 defines a pivot hole 313, in close proximity to the middle portion 31.

The restoring member 4 includes one or more torque springs (torque springs 41), and a pivot shaft 43. First torque arms 411 defines one tangential end of the torque springs 41, and second torque arms 412 defines the other tangential end of the torque springs 41.

Figure 3:
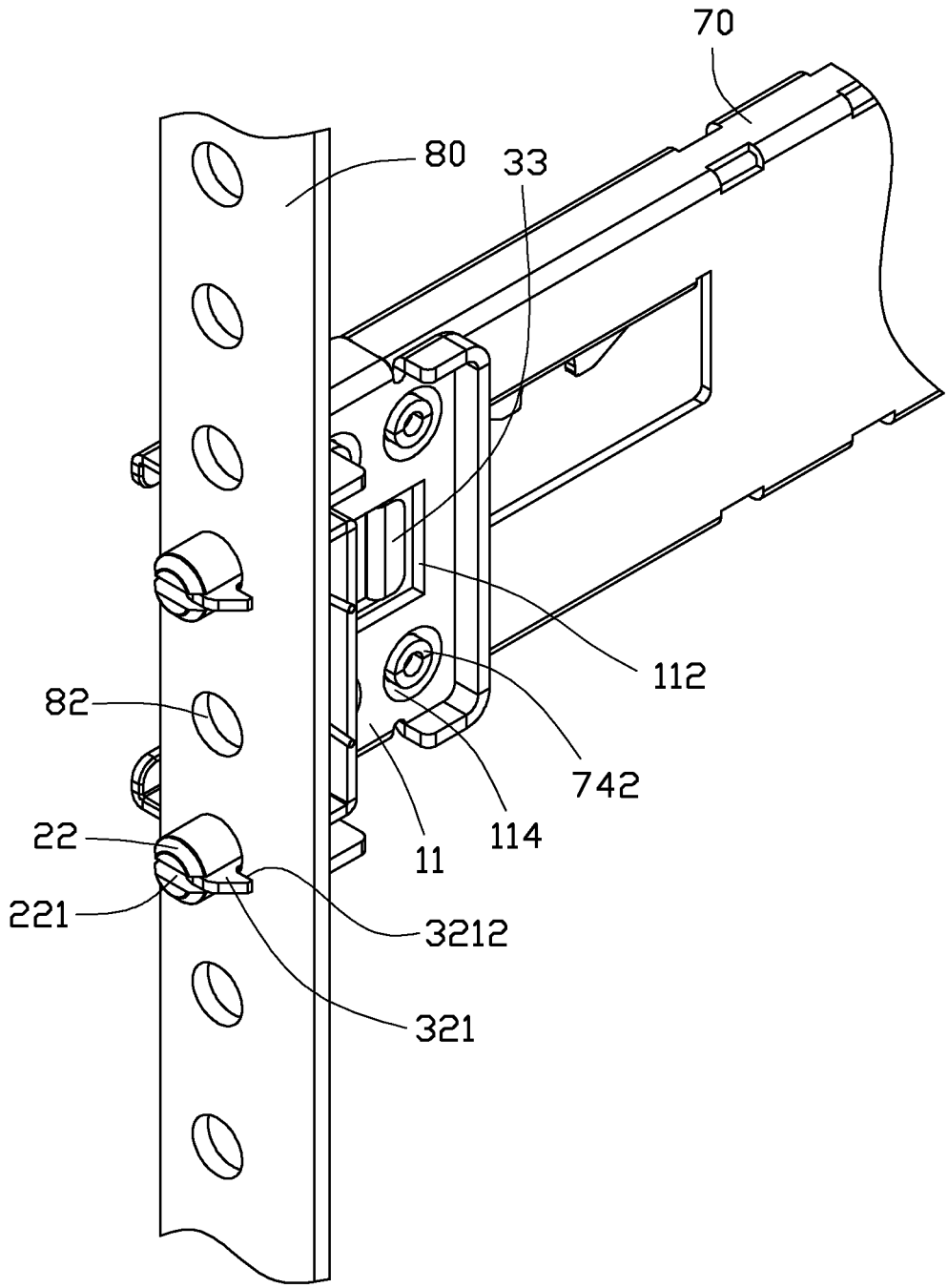
FIGS. 3 and 4 are assembled views of FIG. 1, respectively showing the latch member in the locked and unlocked positions.

Referring to FIG. 3, in assembly, the torque springs 41 are arranged between the arms 32 of the latch member 3. The latch member 3 is arranged between the pivot tabs 121 of the mounting bracket 1. The pivot shaft 43 extends axially through the torque springs 41 and through the pivot holes 313 of the arms 32 of the latch member 3. The latch member 3 is pivotably mounted to the mounting bracket 1, with opposite ends of the pivot shaft 43 respectively fixed in the retaining holes 1211 of pivot tabs 121 of the mounting bracket 1, and the hooked ends of the arms 32 respectively extend through the slide slots 125 of the mounting bracket 1. The inner surface of the end plate 12 resist against the first torque arms 411. The middle portion 31 of the latch member 3 resists against the second torque arms 412. The manipulation portion 33 of the latch member 3 is accessible through the interfere-avoiding hole 112 of the mounting bracket 1. The coupling member 2 abuts the end plate 12 and the hooked ends of the arms 32 extend into the receiving slots 221 of the coupling member 2. Screws (not labeled) go through the positioning holes 212 of the base plate 21 and engage in the securing holes 123 to fix the coupling member 2 to the mounting bracket 1. The hooks 321 of the latch member 3 extend through and out of the inserting pins 22.

The mounting apparatus is installed to the slide rail 70, with the bosses 742 of the slide rail 70 in the corresponding fixing holes 114 of the mounting bracket 1. The manipulation portion 33 of the latch member 3 is aligned with the opening 744 of the slide rail 70.

To mount the slide rail 70 to the component rack with the rack post 80, the inserting pins 22 are slid through holes 82 of the rack post 80, from the rear of the rack post 80. The guiding slopes 3211 prompt the hooks 321 to retract and the torque springs 41 deform elastically to allow the retraction as the inserting pins 22 are slid into place, until the hooks 321 emerge through the front surface of the rack post 80. The torque springs 41, to become unbound, lock and secure the hooks 321, and therefore the complete slide rail 70, against the rack post 80.

Figure 4:
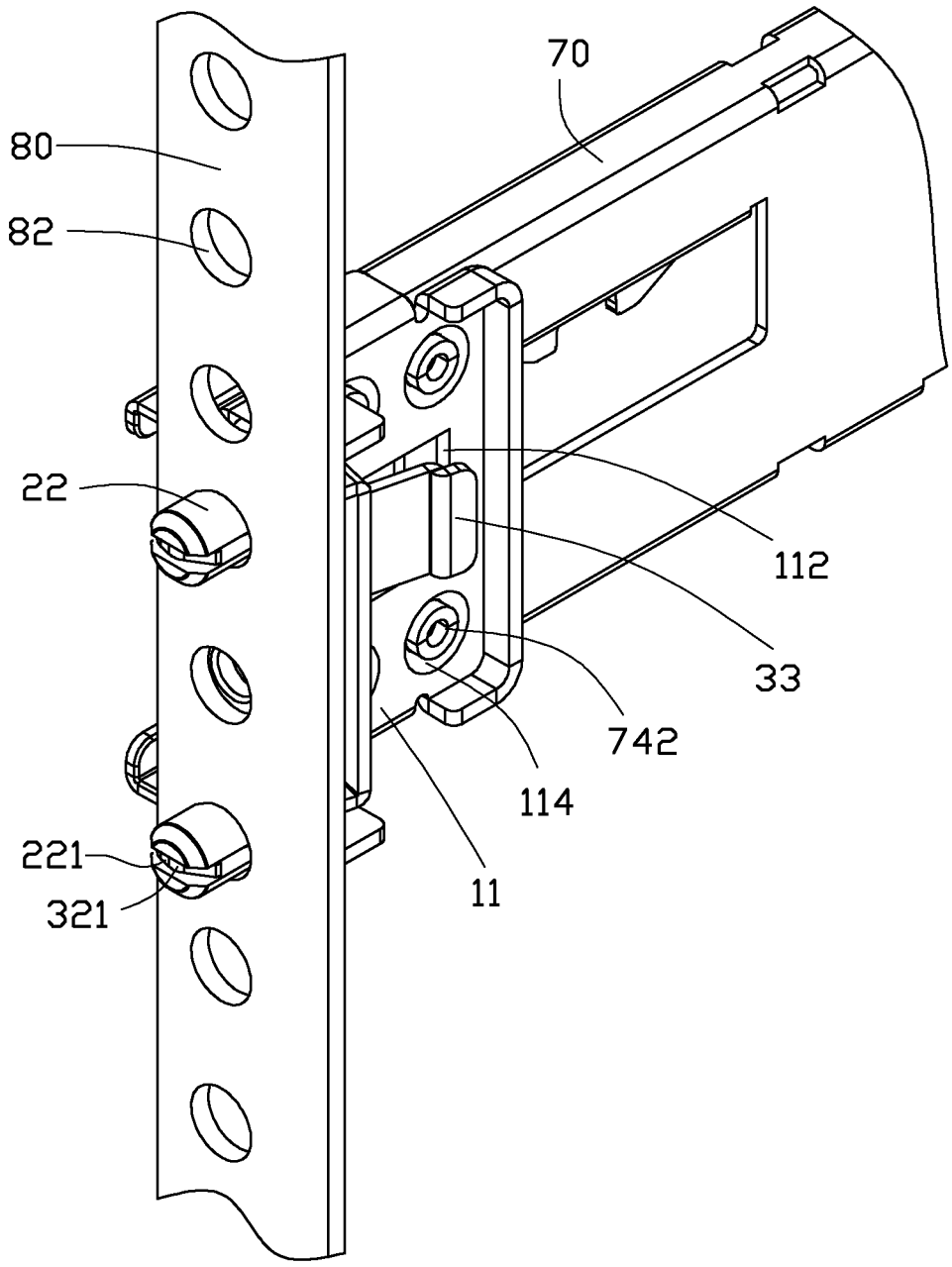

Referring to FIG. 4, detachment of the slide rail 70 requires finger pressure on the manipulation portion 33 of the latch member 3, to pivot the hooks 321 inwards against spring pressure and disengage them, so the inserting pins 22 can be withdrawn from the through holes 82 of the rack post 80.

Figure 5:
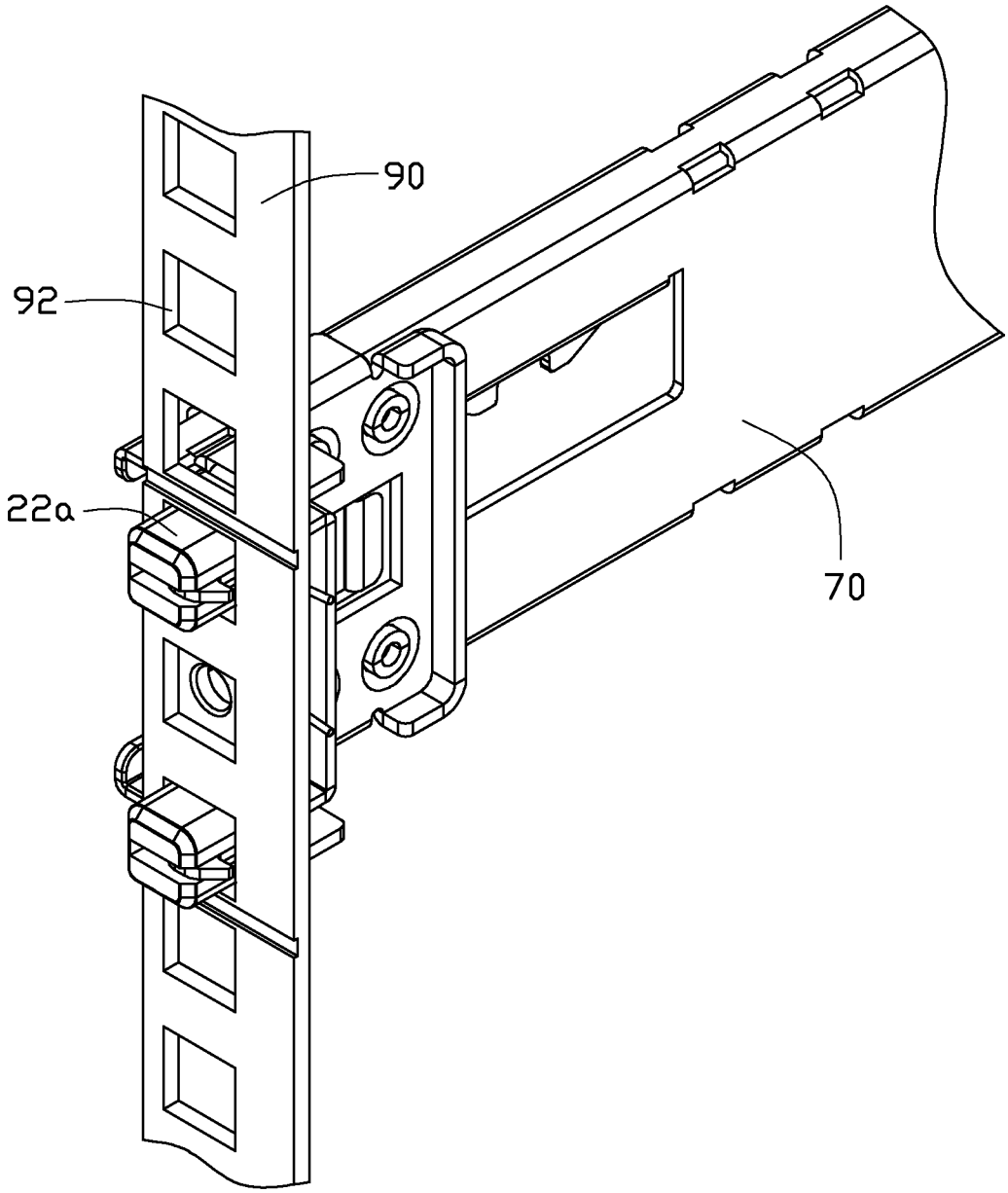
FIG. 5 is an assembled, isometric view of another embodiment of a mounting apparatus, a slide rail, and a rack post.

Referring to FIG. 5, another embodiment of a mounting apparatus requires a plurality of rectangular through holes 92 instead of round through holes 82. Correspondingly, the mounting apparatus includes two inserting pins 22*a* of a square or rectangular cross section in relation to the rack post 90.

It is believed that the present embodiment and its advantages will be understood from the foregoing description, and it will be apparent that various changes may be made thereto without departing from the spirit and scope of the description or sacrificing all of its material advantages, the examples hereinbefore described merely being exemplary embodiments.

What is claimed is:

1. A mounting apparatus for mounting a slide rail to a rack post defining a through hole, the mounting apparatus comprising:

a mounting bracket secured to the slide rail;

a coupling member fixed to the mounting bracket, and comprising an inserting pin to extend through the through hole of the rack post, the coupling member defining a receiving slot axially extending through the inserting pin;

a latch member pivotably mounted to the mounting bracket, and comprising a middle portion and an arm extending from the middle portion into the receiving slot, a hook protrudes from the arm, wherein the latch member is pivotable between a locked position, where the hook of the arm extends out of the receiving slot of the inserting pin to abut against the rack post, and an unlocked position, where the hook is withdrawn in the receiving slot of the inserting pin to disengage from the rack post; and a restoring member connected between the latch member and the mounting bracket to bias the latch member towards the locked position;

wherein the latch member further comprises a manipulation portion extending from the middle portion, opposite to the arm, the mounting bracket defines an interfere-avoiding hole aligned with the manipulation portion.

2. The mounting apparatus of claim 1, wherein the mounting bracket comprises a fixing plate coupled to the slide rail, and an end plate extending from an end of the fixing plate, the coupling member further comprises a base plate fixed to the end plate of the mounting bracket, the inserting pin extends from the base plate, the receiving slot extends through the base plate.

3. The mounting apparatus of claim 1, wherein the restoring member comprises a pivot shaft fixed to the mounting bracket, and a torque spring placed around the pivot shaft, the pivot shaft pivotably extends through the latch member.

4. The mounting apparatus of claim 3, wherein the torque spring comprises a first torque arm resisting against the mounting bracket, and a second torque arm resisting against the latch member.

5. The mounting apparatus of claim 3, wherein the arm of the latch member defines a pivot hole adjacent to the middle portion, the pivot shaft extends through the pivot hole of the arm of the latch member.

6. The mounting apparatus of claim 1, wherein the hook of the latch member forms a guiding slope facing forwards to engage with and slide through the rack post during the inserting pin sliding forwards into the through hole of the rack post.

* * * * *